United States Patent [19]

Jones, Jr.

[11] 4,040,373

[45] Aug. 9, 1977

[54] STEERING AND STABILIZATION APPARATUS FOR WATERCRAFT

[76] Inventor: Allen Jones, Jr., 5028 Lauderdale Ave., Virginia Beach, Va. 23455

[21] Appl. No.: 661,626

[22] Filed: Feb. 26, 1976

Related U.S. Application Data

[63] Continuation-in-part of Ser. No. 579,896, May 22, 1975, abandoned, which is a continuation-in-part of Ser. No. 566,353, April 9, 1975, Pat. No. 3,995,575, which is a continuation-in-part of Ser. No. 279,714, Aug. 10, 1972, Pat. No. 3,881,438.

[51] Int. Cl.[2] ..... B63B 39/06

[52] U.S. Cl. ..... 114/126; 114/280

[58] Field of Search ..... 114/271, 274–284, 114/123, 126, 145 R, 149, 152, 56, 57, 63

[56] References Cited

U.S. PATENT DOCUMENTS

| | | | |
|---|---|---|---|
| 3,063,397 | 11/1962 | Boericke, Jr. | 114/126 |
| 3,247,820 | 4/1966 | White | 114/66.5 H |
| 3,881,438 | 5/1975 | Jones, Jr. | 114/66.5 H |

FOREIGN PATENT DOCUMENTS

| | | | |
|---|---|---|---|
| 349,779 | 3/1922 | Germany | 114/126 |
| 1,039,592 | 8/1966 | United Kingdom | 114/126 |

*Primary Examiner*—Trygve M. Blix
*Assistant Examiner*—Stuart M. Goldstein
*Attorney, Agent, or Firm*—J. Maxwell Carson, Jr.

[57] ABSTRACT

Vane members are movably mounted on the hulls of watercraft to serve steering and stabilization functions. Several embodiments are disclosed, some of which rotate between extended and shielded positions, others of which fold to vary the angle at which they extend from their associated hull, and still others of which both rotate and fold to facilitate storage alongside planar hull portions. Both shaft and surface bearing vane mounting systems are described. In preferred practice, the vanes are used on hydrofoil-carrying semidisplacement ships, and the provision of stowably mounted hydrofoils, planing surfaces, and wave form generators on such ships is also disclosed.

13 Claims, 42 Drawing Figures

STEERING AND STABILIZATION APPARATUS FOR WATERCRAFT

CROSS REFERENCE TO RELATED APPLICATIONS

The present application is a continuation-in-part of application Ser. No. 579,896 filed May 22, 1975 (now abandoned), here the "Parent Application", the disclosure of which is incorporated by reference.

The Parent Application was a continuation-in part of application Ser. No. 566,353 filed Apr. 9, 1975 now U.S. Pat. No. 3,995,575 issued Dec. 7, 1976, as a continuation-in-part of application Ser. No. 279,714 filed Aug. 10, 1972, issued May 6, 1975 as U.S. Pat. No. 3,881,438, here the "Parent Patents," the disclosures of which are incorporated by reference.

BACKGROUND OF THE INVENTION

1. Field of the Invention

The present invention relates to steering and stabilization apparatus for vessels.

2. Prior Art

Proposals have been made to equip vessels of various configurations with steering apparatus suited to guide ship movement in both shallow and deep waters. Most such proposals have included one or more rudders pivoted about substantially vertical axes and positioned toward the rear of the vessel's hull.

Other proposals have been made to equip vessels with stabilization apparatus such as port and starboard surface piercing hydrofoils. If the vessel rolls toward one side or the other, the foils tend to correct the roll inasmuch the exposed surface area of one foil is increased while the exposed surface area of the other foil is decreased. One proposal has been made to pivotally mount lift-producing, surface-piercing hydrofoils on a surface watercraft for movement about substantially horizontal axes to provide lateral stabilization at controllable bank angles.

A problem with prior steering and stabilization proposals has been that the rudders or foils they employ are not movable between sheltered and extended positions. To the extent that some rudders or foils have been mounted for movement to retracted or storage positions, such structures have not been operable in their retracted or storage positions. An additional problem with prior steering apparatus proposals is that they provide no "heeling" function, i.e. they do not assist in baking the ship as is required for relatively high speed maneuvers.

THE PARENT PATENTS

The referenced Parent Patents describe semidisplacement ships provided with submerged hydrofoils to raise their hulls in the water when the ships are underway. The hulls are not raised out of the water during cruising, but rather are raised a sufficient amount to substantially reduce wetted surface area and attendant drag forces.

A significant feature of the described ships is the cross section of their hulls. The sides of each of the hulls have upper, lower and intermediate portions. The upper portions are relatively widely spaced. The lower portions are relatively narrowly spaced. The intermediate portions form inclined transition surfaces between the upper and lower portions.

When the described ships are at rest in the water, the displacement water line is near the junctures of the upper and intermediate portions. At this time, a substantial portion of the hulls are submerged and the ships are wholly supported by displacement forces.

When the described ships are cruising, lift forces derived from the hydrofoils lift the hulls such that the cruising water line is near the junctures of the lower and intermediate portions. At this time, substantial portions of the hulls are still submerged and displacement forces still contribute significantly to the support of the ships; but the relatively large surface area of the inclined intermediate portions is now out of the water. The resulting decrease in wetted surface area substantially reduces drag and permits increased operating speeds with a savings in fuel consumption.

Raising a hull of the described type in the water by X linear units will reduce the wetted hull surface by X times the secant of the angle by which the sides are inclined from the vertical. By substantially confining the inclined portions of the sides to the region of the hull which rises out of the water, the angle of side inclination can be selected to maximize the amount of wetted surface area that will be removed from the water with each linear unit of rise of the hull.

A desirable angle of inclination of the intermediate side portions is within the range of 35°–55°. This range of angles provides the intermediate side portions with a sufficient angle of inclination to dissipate the impact of wave pounding, and yet provides a secant of within the approximate range of 1.2 to 1.7 which, as was previously explained, will effect a rapid reduction of the wetted hull surface as the ship gets underway.

The hydrofoils of the described ships are supported on the submerged keel sections of their hulls. The hydrofoils preferably do not protrude beyond the maximum width of the deck of the ships, thereby enabling the ships to use conventional docking facilities. Thy hydrofoils are preferably movably mounted so that the front portion of each foil can be elevated relative to its rear portion to increase lift, or lowered relative to its rear portion to decrease lift.

Another feature of the described ships lies in the positioning of the foils in groups so that the hydrofoils of each group can provide substantially a contiguous surface to raise the hull as the ships get underway. The adjacent foils of each group are arranged in close proximity to each other with the forward foils positioned higher than their adjacent rearward foils. By this arrangement, the foils can be rotated to a position of alignment wherein the adjacent foils provide continuous high-lift surfaces on each side of a ship to increase lift and decrease the amount of time needed to reach cruising speed and attitude.

It is estimated that the described ships can be used to transport cargo at approximately 20 knots on the same amount of fuel used by conventional displacement hull ships in attaining between 12 and 15 knots of speed. Estimates are that 30 knots of speed are attainable for a 20-knot fuel bill. Accordingly, greater economies are found in high-speed operation than are available to conventional ships.

The advantages of the described hull cross section accordingly include:

1. A deep-submergence hull is provided which does not raise the hull out of the water and accordingly does not subject the bottom of the hull to wave pounding.

2. A minimal wetted surface area is held in the water, thereby minimizing drag.
3. A stable cargo-supporting platform is provided by the deep-submergence hull which is subject to minimal pitch in choppy seas.
4. Since the submerged kneel section is of relatively small cross section, it can easily be rigidly braced to withstand high impact loads.
5. The slim cross section of the submerged keel section permits the use of relatively long hydrofoils along opposite sides without causing these hydrofoils to extend beyond the maximum width of the cargo-carrying deck.
6. The hull cross section can be increased or decreased in scale to provide larger or smaller ships.

A problem not addressed by either of the Parent Patents is that of providing a combination stabilization and steering system for the described ships. When the described ships are underway and the hydrofoils are operating to raise much of the ship's hulls out of the water, the ships may, at times, be relatively unstable. While the hydrofoils act as stabilizers and are rotatably mounted to function as roll conrols, it is desirable, especially where such ships are to be used in heavy seas, to provide the described ships with additional stabilization means.

An additional problem not specifically addressed by the Parent Patents is that of "heeling," i.e., coordinating the banking of the described ships with turning to facilitate stable steering maneuvers. Still another problem not addressed by the Parent Patents is that of providing the described ships with an apparatus for operating the ships at controlled angles of list as may be required where substantial crosscurrents are encountered or where the ships carry unbalanced loads.

SUMMARY OF THE INVENTION

The present invention overcomes the foregoing and other drawbacks of the prior art and provides a novel and improved steering and stabilization apparatus for vessels.

While apparatus embodying the present invention is preferably used on such ships as are described in the Parent Patents, such apparatus can be used to advantage on other types of ships including sail boats, displacement supported ships, submarines and the like. Where apparatus embodying the present invention is used on such ships as are described in the Parent Patents, several especially advantageous results obtain as will be described.

In accordance with one feature of the present invention, vane members are rotatably mounted in pairs on opposite sides of submerged hull portions. In the preferred embodiment, the vane members have substantially planar portions that flare obliquely outwardly relative to their supporting hull portions. When the vane members on opposite sides of a ship's hull are counter-rotated to selectively expose their upper and lower surfaces to the flow of water moving alongside the ship's hull, they serve steering and heeling functions. When the vane members on opposite sides of a ship's hull are rotated in unison in the same direction, they can act in the manner of diving planes to raise and lower the ship. Vane members of this type find particular use on submarines.

In accordance with another feature of the invention, a pair of vane members are interconnected by a mounting structure and are mounted on the underside of a ship to replace or augment conventional rudders. In this embodiment, the vane members extend obliquely to the ship's underside and are capable of serving steering and heeling functions. Interconnected vane members of this type are preferably located in surrounding relationship to the ship's propellor, or rearwardly thereof to operate in the wash of the propellor.

In another embodiment, vane members are hingedly connected to a rotatable support for folding between extended and storage positions. The vane members are preferably configured such that when they are in storage positions, the drag forces encurred by the vane members are balanced about the axes of rotation of the vane members. In other embodiments, an axial balance of drag forces is achieved at selected angles of extension of the vane members and the vane members are normally operated at these "balance angles."

A feature of the preferred vane embodiments is that they are rotatable between sheltered and extended positions. In their sheltered positions the vane members preferably overlie or lie alongisde hull portions that extend obliquely to the vane-mounting hull portions.

One drive mechanism for movably supporting and positioning vane members includes vane mounting shafts which extend through the hull for rotating the vane members between their sheltered and extended positions. The drive system is also operable to counter-rotate the vane members once the vane members are in either of their extended or sheltered positions to provide steering and heeling functions. Other functions such as ship stabilization, bank control, braking and movement of the craft through water at a desired angle of list can be effected by proper relative positioning of the vane members by the drive mechanism.

A preferred drive mechanism includes a disc-like vane mounting structure which is peripherally journaled by a large surface area, self-cleaning, tapered, water-lubricated bearing. Bearings of this type are commerically available for marine applications and are well suited to transmit forces efficiently between the mounting structure and the hull.

As will be apparent from the foregoing summary, it is a general object of the present invention to provide a novel and improve watercraft.

Another object is to provide a novel and improved steering and stabilization apparatus for watercraft.

Still another object is to provide such ship structures as are described in the Parent Patents with improved steering, stabilization and bank control apparatus.

DESCRIPTION OF THE PREFERRED EMBODIMENT

Figure 1:
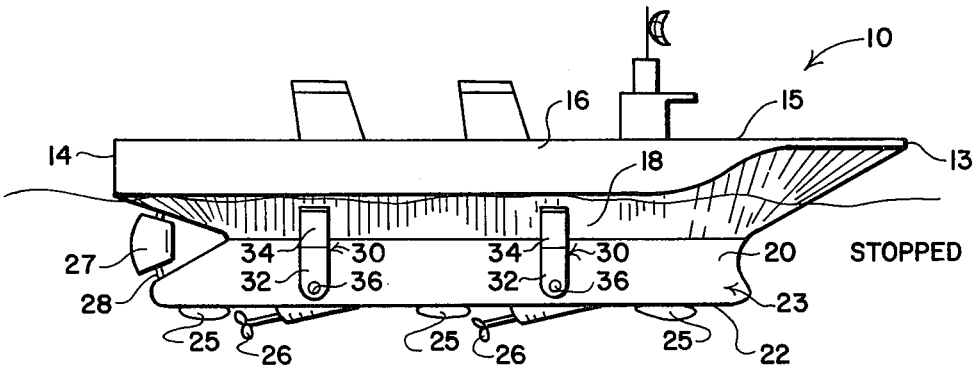
FIGS. 1 and 2 are side elevational views which show one embodiment of a ship incorporating certain aspects of the present invention with the ship stopped and underway, respectively.

Referring to FIGS. 1–4, a semidisplacement hydrofoil ship is shown generally at 10. The hull of the ship 10 has starboard and port sides 11, 12 which converge at opposite ends to form a blunt but generally pointed bow 13 and a substantially planar transom 14 at the stern.

The hull of the ship 10 has a cross section which provides a stable deep-submergence vessel. The sides 11, 12 are each divided into upper, lower, and intermediate portions. The upper portions of the sides 11, 12 are widely spaced, substantially vertical freeboard portions 16, 17 which extend along opposite sides of a flat, substantially unobstructed deck 15. The lower portions of the sides 11, 12 are closely spaced, substantially vertical keel portions 20, 21 which are joined at the bottom by a keel surface 22. The keel surface 22 and the keel portions 20, 21 define a narrow base or submerged keel section 23 of the hull. The intermediate portions of the sides 11, 12 are inclined displacement and stabilizing portions 18, 19 which provide a transition between the keel and freeboard portions 20, 21 and 16, 17.

The spacing between the freeboard portions 16, 17 is preferably within the range of about 2 to 20 times the spacing between the keel protions 20, 21. A preferred relationship for large cargo ships has the keel portions 20, 21 spaced about one-third the distance between the freeboard portions 16, 17 at a majority of locations along the length of the hull.

A plurality of hydrofoils 25 are supported on the keel section 23. As is described in the referenced Parent Patents the hydrofoils 25 may be relatively closely spaced in fore and aft groups and extend from opposite sides of the lower portions 20, 21, or may be arranged in spaced relationship along any desired portion of the displacement keel 23. Power operated actuators are described in the Parent Patents for rotating the hydrofoils to control the lift, roll and pitch of the ship 10.

The ship 10 is provided with two tube-supported propellers 26 located in tandem along the bottom surface 22 of the keel section 23. The propellers 26 are preferably driven by separate turbojet engines carried in the keel section 23. Any desired number of propellers 26 can be mounted in tandem along the length of the keel section 23 as required to give the required propulsion force to the ship 10. Such tandem propellers are preferably each driven by a separate engine, but all may be driven from a common power plant.

Figure 2:
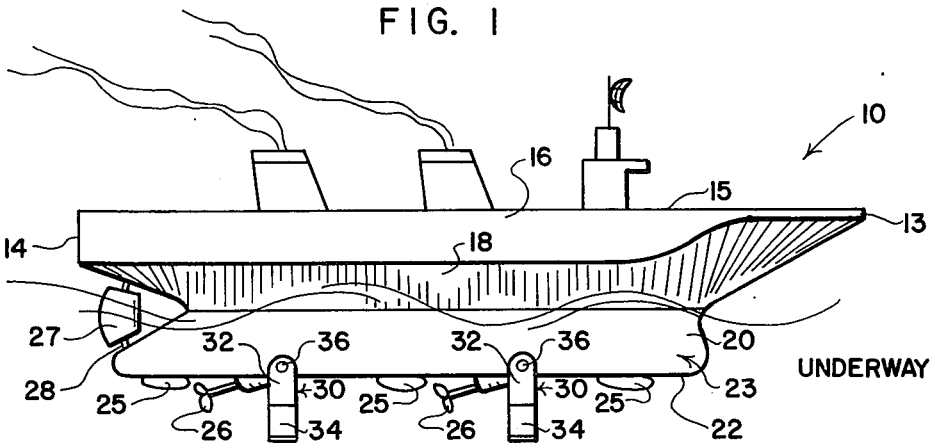

When the ship 10 docked or otherwise at rest in the water, it is supported only by displacement forces. The displacement water line of the ship when at rest is ordinarily near the juncture of the freeboard and displacement portions 16, 18 and 17, 19 as shown in FIG. 1. When the ship 10 is underway, it is supported in part by the action of the hydrofoils, and the cruising water line is near the juncture of the keel and displacement portions 18, 20 and 19, 21 as shown in FIG. 2. Accordingly, only the keel section 23 of the hull is normally submerged when the ship is underway.

The ship 10 is provided with a rudder 27. A shaft 28 extends through the rudder 27 and has opposite ends journaled in the keel section 23 and in the transom 14.

As the ship 10 rises in the water during its transition from a displacement-supported mode to a displacement-and-hydrofoil-supported mode, the wetted surface area of the rudder 28 decreases. Such a decrease in wetted surface area is desirable because at higher speeds less rudder surface area is required to turn the ship 10.

In accordance with one feature of the present invention starboard and port vane members 30, 31 are respectively positioned on starboard and port sides of the ship 10. The vane members 30, 31 include mounting sections 32, 33 which extend alongside the lower hull portions 20, 21, and flared sections 34, 35 which flare outwardly from the mounting sections 32, 33.

Figure 8:
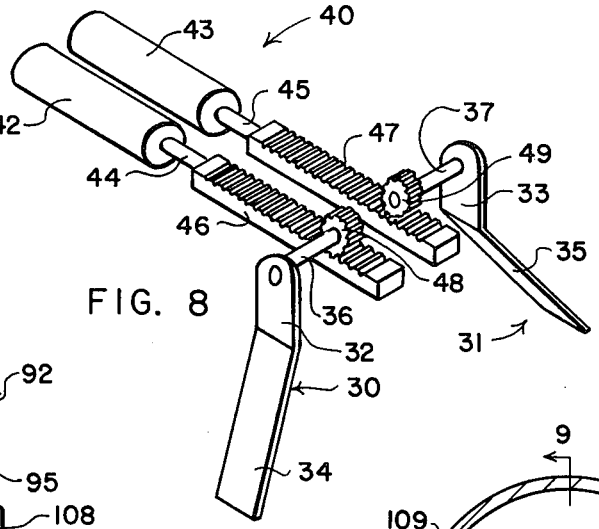
FIG. 8 is a perspective view of one drive mechanism embodiment for moving the vane members.

The vane members 30, 31 are movably mounted on the keel section 23. One drive mechanism embodiment that can be used to position the vane members 30, 31 is shown in FIG. 8. A pair of mounting shafts 36, 37 extend through and are journaled for rotation by the lower hull portions 20, 21. The shafts 36, 37 connect to the mounting sections 32, 33 to mount the vane members 30, 31 for rotation. The axes of the shafts 36, 37 are preferably substantially horizontal and extend transversely of the length of the ship 10.

Figure 3:
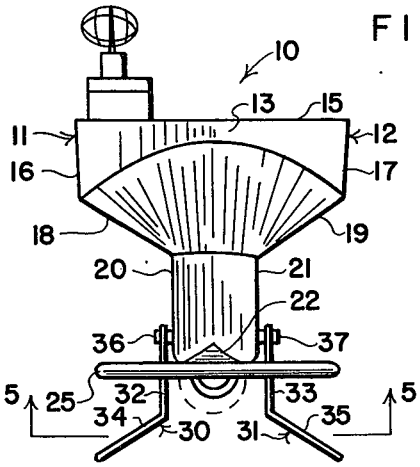
FIGS. 3 and 4 are bow elevational views of the ship of FIGS. 1 and 2 with vane members in operating and sheltered positions, respectively.
Figure 4:
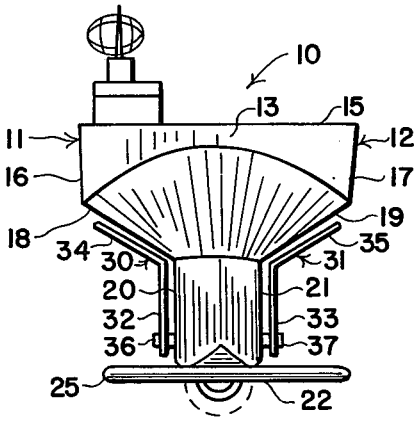

The drive mechanism 40 is housed within the displacement keel 23 and connects with the shafts 36, 37 to rotate the shafts and position the vane members 30, 31 between sheltered positions shown in FIGS. 1 and 4, and extended positions shown in FIGS. 2 and 3. The drive mechanism 40 includes a pair of conventional fluid actuated cylinders 42, 43. The cylinders 42, 43 have pistons 44, 45 which are extensible and retractible in response to a supply of pressurized fluid.

A pair of toothed gear racks 46, 47 are connected to the pistons 44, 45, respectively. A pair of gears 48, 49 are mounted on the shafts 36, 37. The gear racks 46, 47 drivingly engage the gears 48, 49 to rotate the gears 48, 49 in response to reciprocation of the gear racks 46, 47 by the pistons 46, 47. Pressurized fluid can be supplied to the cylinders 42, 43 by any of a variety of commerically available control mechanisms which need not be described.

The vane members 30, 31 can be used in combination with or in place of the rudder 27 to steer the ship 10. A steering function can be obtained by rotating the vane members 30, 31 in opposite directions regardless of whether the vane members 30, 31 are in their sheltered position (FIGS. 1 and 4) or their extended position (FIGS. 2 and 3).

Figure 5:
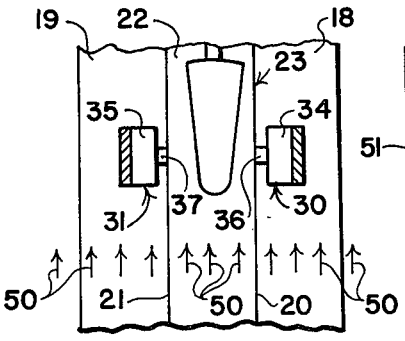
FIG. 5 is a cross-sectional view as seen from a plane indicated by a line 5—5 in FIG. 3.
Figure 6:
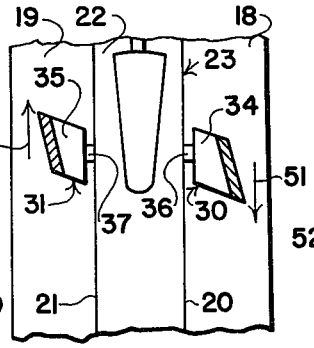
FIGS. 6 and 7 are cross-sectional views similar to FIG. 5 but with the vane members counter-rotated to steer the ship.
Figure 7:
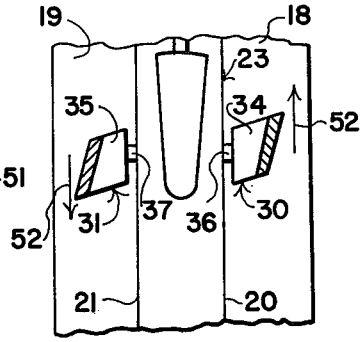

The manner in which the vane members 30, 31 operate to provide a steering function is illustrated in FIGS. 5–7. In FIGS. 5–7, the vane members 30, 31 are shown in cross section as seen from horizontal planes which parallel the bottom surface of the keel section 23, as indicated by the line 5—5 in FIG. 3.

Referring to FIG. 5, water flowing along the bottom of the ship 10 as the ship moves forwardly through a body water is indicated by arrows 50. With the vane members 30, 31 depending in parallel vertical fashion into the water below the ship 10, the cross sections of the vane members 30, 31 parallel the water flow indicated by the arrows 50. The vane members 30, 31 accordingly serve no turning function when positioned as shown in FIG. 5, but do serve to steer the ship 10 on a straight ahead course of movement.

Referring to FIGS. 6 and 7, if the shafts 36, 37 are counter-rotated as indicated either by arrows 51 or 52, it will be seen that the outboard surface of one of the flared sections 34, 35 and an inboard surface of the other of the flared sections 34, 35 is exposed to the water moving past the vane members 30, 31 and the vane members 30, 31 therefore serve to steer the ship 10 to port or starboard.

While FIGS. 5–7 illustrate the steering action and stabilization action which is effected by the vane members 30, 31 when the vane members are extended, it will be apparent that the same sort of steering action can be effected when the vane members 30, 31 are counter-rotated about their sheltered positions.

Still another function for which the vane members 30, 31 can be utilized is to control the roll of the ship 10. When the vane members 30, 31 counter-rotated about either of their extended or sheltered positions, one of the flared sections 34, 35 will expose its upper surface to water flowing along the ship 10, while the other of the flared sections 34, 35 will expose its lower surface to the water flow. The vane members 30, 31 accordingly serve to bank the ship 10. This banking or heeling action is coordinated with the described steering action and facilitates stable turning maneuvers of the ship 10.

Still another function, namely, a braking action, can be achieved by the vane members 30, 31 by rotating the vane members to substantially horizontal positions where the flared portions 34, 35 oppose the flow of water passing along the ship 10.

An important function which is readily served by the vane members 30, 31 is that of stabilizing the ship 10. The large wetted area of the vane members 30, 31 helps stabilize the ship regardless of whether the ship 10 is stopped or underway. When the vane members 30, 31 are rotated to their extended positions, they depend deeply below the ship's hull into waters that are less affected by wave action and accordingly help stabilize the ship in heavy seas.

Still another function which can be served by the vane members 30, 31 is that of moving the ship at an angle of list as may be necessary where cross currents of large magnitude are encountered or where the ship's loading is substantially unsymmetrically balanced.

Any number of vane membrs 30, 31 can be provided along the length of the ship 10 as may be required to achieve the desired steering, stabilization or other function. A plurality of vane members can be supported in tandem bi-plane fashion on common shafts. The wetted surface area of the vane members 30, 31 is selected to provide adequate control surface areas to achieve the desired steering, stabilization or other function.

Figure 9:
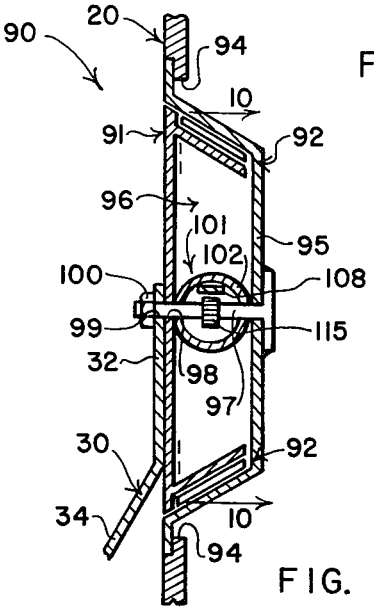
FIGS. 9 and 10 are sectional views of an alternate drive mechanism embodiment for moving the vane members.
Figure 10:
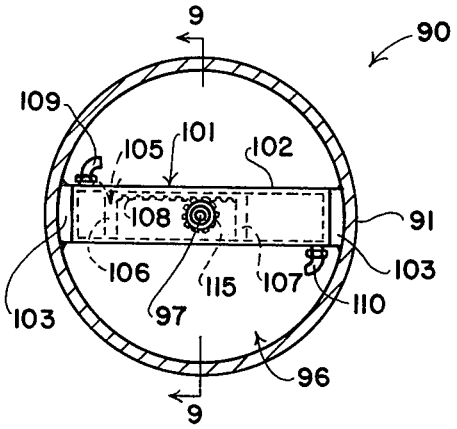

Referring to FIGS. 9 and 10, an alternate and preferred vane mounting and drive system embodiment is indicated by the numeral 90. The system 90 utilizes a disc structure 91 which mounts the inner end portion 32 of of one of the vanes 30. A large surface area, tapered, self-cleaning, water lubricated bearing 92 journals the periphery of the disc structure 91 in a cavity provided in the hull portion 20. Bearings of this type are commercially available for marine applicatons and need not be described.

Referring to FIG. 9, and opening 94 is formed through the hull portion 20. A mounting plate 95 extends through and closes the opening 94, and is rigidly secured to the hull portion 20 as by welding. An outwardly facing recessed cavity 96 is defined by the plate 95. A stub shaft 97 is rigidly carried by the plate 95 and extends centrally through the cavity 96.

A hole 98 is formed through the disc structure 91. An aligned hole 99 is formed through the vane portion 32. The stub shaft 97 extends through the holes 98, 99. A fastener 100 receives the outer end of the stub shaft 97 and holds the disc structure 91 in place in the recessed cavity 96.

A hydraulic actuator assembly 101 is supported inside the disc structure 91 for rotating the vane 30. Referring to FIG. 10, the actuator 101 is of a commercially available type and includes a hollow cylindrical housing 102. Opposite ends of the housing 102 are rigidly connected to the disc structure 91 by a pair of brackets 103.

A piston 105 is movably supported inside the housing 102. The piston 105 includes spaced end portions 106, 107 which slip-fit within the walls of the housing 102 and which carry conventional seals (not shown). A gear rack 108 interconnects the end portions 106, 107. Hydraulic lines 109, 110 connect with the housing 102 and communicate with opposite ends of the chamber defined inside the housing 102. The piston 105 moves inside this chamber in response to a supply of pressurized fluid through the hydraulic lines 109, 110.

A pinion 115 is rigidly connected to the stub shaft 97 and drivingly engages the gear rack 108. By this arrangement, when the piston 105 moves relative to the housing 102, the driving connection between the gear rack 108 and the pinion 115 forces the housing 102 to rotate relative to the stub shaft 97. The disc structure 91 and the vane 30 rotate with the housing 102.

The mounting and drive system embodiment 90 has several advantages over the embodiment 40. Principal among the advantages is that a large surface area bearing is provided to transmit forces from the vane 30 to the hull portion 20. An additional advantage is that the drive mechanism is compact and does not require space inside the hull. Moreover, the entire mechanism can easily be removed and replaced without exposing openings through the hull.

Figure 11:
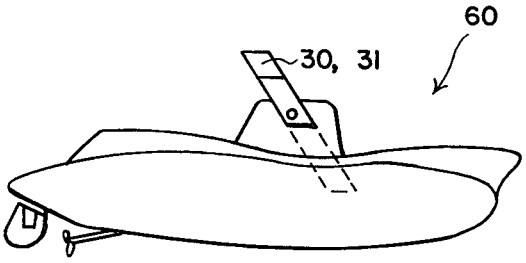
FIGS. 11, 12 and 13 are side elevational views of other ship embodiments employing vane members in accordance with other aspects of the present invention.
Figure 12:
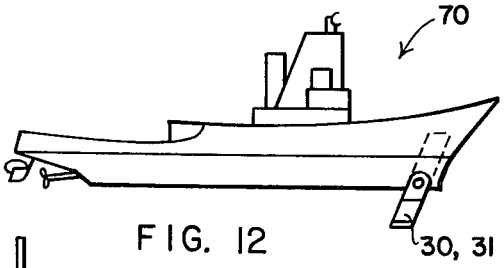
Figure 13:
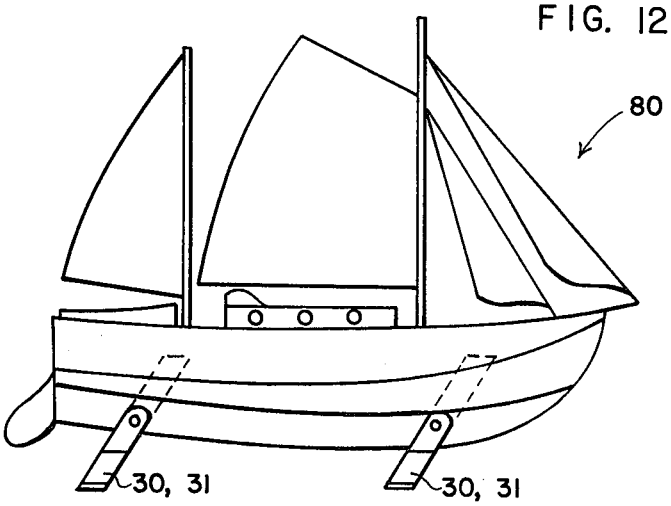

The usefulness of the vane members of the present invention is not confined to semi-displacement ships of the type described in the Parent Patents. Referring to FIGS. 11, 12 and 13, vane members 30, 31 are shown mounted on a submarine 60, a conventional displacement ship 70, and a sailing vessel 80. In each of the applications shown in FIGS. 11–13, the vane membrs 30, 31 have mounting sections which are movably secured to relatively closely spaced hull portions. The vane members 30, 31 are positionable in sheltered positions (shown in phantom) where the vane members have sections which lie along-side hull portions which are, at least in part, relatively widely spaced. The vane members 30, 31 are movable from such sheltered positions to extended positions where they extend away from such widely spaced hull portions.

The vane members 30, 31 shown in FIGS. 11 and 12 are of a swept-back design which, from a bow elevational view have the same appearance as the vane members 30, 31 shown in FIGS. 3, 4.

Where used on missle-carrying warships and the like, the vane members 30, 31 are very useful in stabilizing the ship to provide a stable launching platform that is less subject to reaction movements as missles are launched.

A significant advantage of the vane members 30, 31, regardless of the function they are selected to serve, is that they can be moved to sheltered positions when it is desirable to reduce the cross-sectional size of their ship. A further advantage is that the vane members 30, 31 can be used to steer or stabilize their ship regardless of whether they are in extended or sheltered positions. By this arrangement, the ship can operate in both shallow and deep waters.

Figure 14:
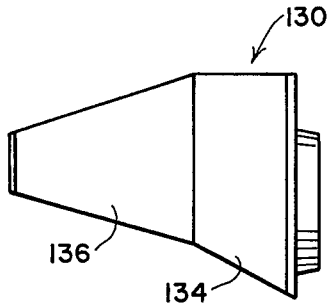
FIGS. 14, 16, 18, and 20 are top plan views of alternate vane embodiments.
Figure 15:
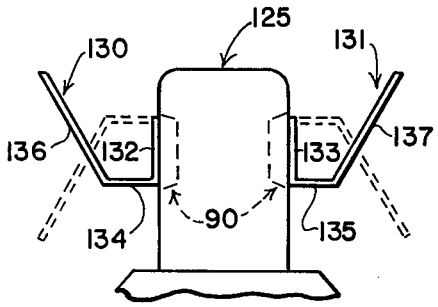
FIGS. 15, 17, 19 and 21 are end elevational views of the vane embodiments of FIGS. 14, 16, 18 and 20 mounted on the conning tower of a submarine.

Referring to FIGS. 14 and 15, vane members of another configuration are indicated by the numerals 130, 131. The vane members 130, 131 include mounting sections 132, 133 planing sections 134, 135, and flared sections 136, 137. The described mounting and drive system embodiment 90 is preferably used to mount the vane members 130, 131 on the conning tower of a submarine, as indicated by the numeral 125.

The vane members 130, 131 are rotatable between extended operating positions, shown in solid lines in FIG. 15, and sheltered operating positions shown in phantom. In the sheltered positions, the flared sections 136, 137 overlie the submarine's hull and provide a relatively low profile. When the vane members 130, 131 are rotated concurrently in the same direction, they operate as diving planes. When the vane members 130, 131 are counter-rotated they operate as described in conjunction with FIGS 5–7 to provide steering and heeling functions. The vane members 130, 131 are preferably constructed such that drag forces impose on vane surface areas located above and below the axes of rotation of the vane members 130, 131 equalize and thereby tend to maintain the vane members 130, 131 in alignment with the flow stream of water.

Figure 16:
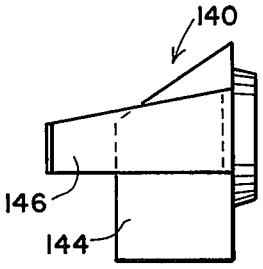
Figure 17:
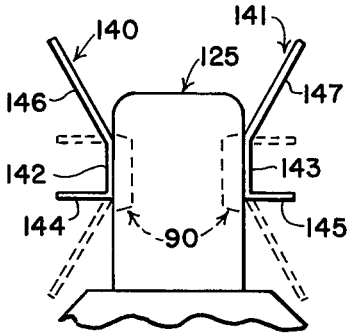

Referring to FIGS. 16 and 17, vane members of another configuration are indicated by the numerals 140, 141. The vane members 140, 141 include mounting sections 142, 143, planing sections 144, 145, and flared sections 146, 147. The described mounting and drive system embodiment 90 is preferably used to mount the vane members 140, 141 on the conning tower of a submarine, as indicated by the numeral 125.

The vane members 140, 141 are rotatable between extended operating positions, shown in solid lines in FIG. 17, and sheltered operating positions shown in phantom. In the sheltered positions, the flared sections 146, 147 overlie the submarine's hull and provide a relative low profile. When the vane members 140, 141 are rotated concurrently in the same direction, they operate as diving planes. When the vane members 140, 141 are counter-rotated, they operate as described in conjunction with FIGS. 5–7 to provide steering and heeling functions. The vane members 140, 141 are preferably constructed such that drag forces imposed on vane surface areas located above and below the axes of rotation of the vane members 140, 141 equalize and thereby tend to maintain the vane members 140, 141 in alignment with the flow stream of water.

Figure 18:
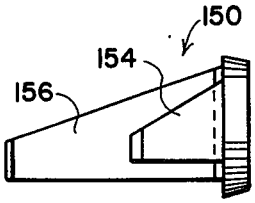
Figure 19:
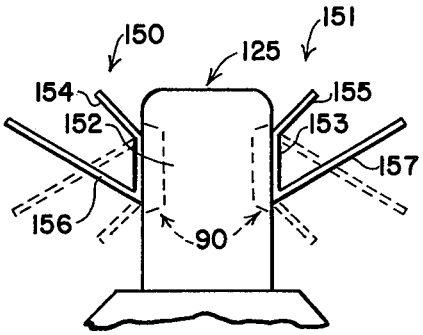

Referring to FIGS. 18 and 19, vane members of another configuration are indicated by the numerals 150, 151. The vane members 150, 151 include mounting sections 152, 153, short flaring sections 154, 155, and long flaring sections 156, 157. The described mounting and drive system embodiment 90 is preferably used to mount the vane members 150, 151 on the conning tower of a submarine, as indicated by the numeral 125.

The vane members 150, 151 are rotatable between extended operating positions, shown in solid lines in FIG. 19, and sheltered operating positions shown in phantom. In the sheltered positions, the flaring sections 154, 155, 156, 157 overlie the submarine's hull and provide a relatively low profile. When the vane members 150, 151 are rotated concurrently in the same direction, they operate as diving planes. When the vane members 150, 151 are counter-rotated, they operate as described in conjunction with FIGS. 5–7 to provide steering and heeling functions. The vane members 150, 151 are preferably constructed such that drag forces imposed on vane surface areas located above and below the axes of rotation of the vane members 150, 151 equalize, and thereby tend to maintain the vane members 150, 151 in alignment with the flow stream of water.

Figure 20:
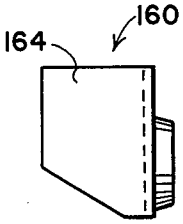
Figure 21:
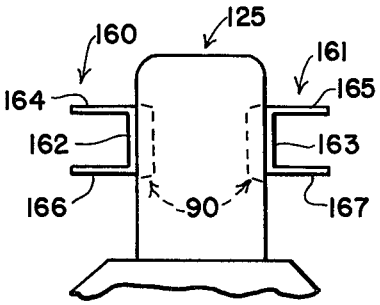

Referring to FIGS. 20 and 21, vane members of another configuration are indicated by the numerals 160, 161. The vane members 160, 161 include mounting sections 162, 163, and upper and lower planing sections 164, 165 and 166, 167. The described mounting and drive system embodiment 90 is preferably used to mount the vane members 160, 161 on the conning tower of a submarine, as indicated by the numeral 125.

While the vane members 160, 161 are rotatable, they do not, in the matter of the previously described vane members, move between extended and operating positions. When the vane members 160, 161 are rotated concurrently in the same direction, they operate as diving planes. When the vane members 160, 161 are counter-rotated, they provide a heeling function but to a less efficient degree than the previously described vane embodiments. The vane members 160, 161 are preferably constructed such that drag forces imposed on vane surface areas located above and below the axes of rotation of the vane members 160, 161 equalize and thereby tend to maintain the vane members 160, 161 in alignment with the flow stream of water.

Figure 22:
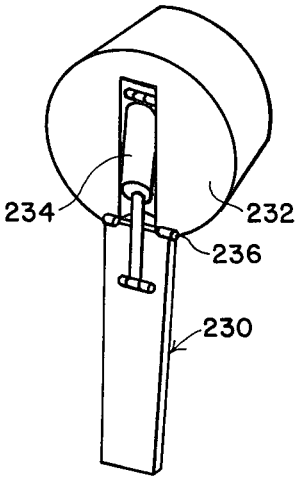
FIG. 22 is a perspective view of a folding vane embodiment.
Figure 23:
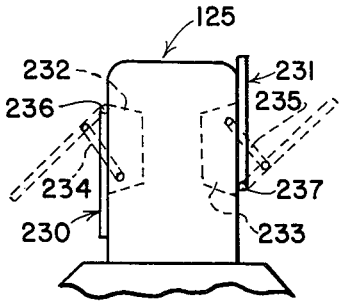
FIG. 23 is an end elevational view showing the vane of FIG. 22 mounted on the conning tower of a submarine.

Referring to FIGS. 22 and 23, folding vane members are indicated by the numerals 230, 231. The vane members 230, 231 can be mounted on such ship surfaces as the conning tower of a submarine, as indicated by the numeral 125. The vane members 230, 231 are preferably rotatably mounted as by a drive system embodiment of the type shown in FIGS. 9 and 10. Disc-shaped mounting members 232, 233 are journaled in tapered, self-cleaning, large surface area water lubricated bearings, as described. Hydraulic cylinders 234, 235 connect at one end with the disc structures 232, 233 and at the other end with the vane members 230, 231. Hinges 236, 237 pivotally connect the disc structures 232, 233 and the vane members 230, 231. By this arrangement, the vane members 230, 231 are movable between sheltered positions lying alongside the disc structures 232, 233, and such flaring positions as are shown in phantom in FIG. 23.

While the vane members 230, 231 are ordinarly both concurrently positioned in either upwardly or downwardly extending directions, the vane members 230, 231 as illustrated in FIG. 23 are shown one in a downwardly extending position and one in an upwardly extending position to illustrate the range of their movements. When the vane members 230, 231 are in flaring positions and are rotated together, they operate as diving planes. When the vane members 230, 231 are in flaring positions and are counter-rotated, they operate as described in conjunction with FIGS. 5–7 to provide steering and heeling functions.

Figure 24:
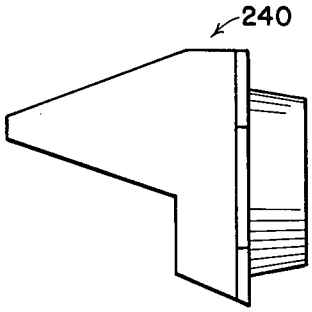
FIGS. 24 and 25 are top plan and end elevational views of an alternate folding vane embodiment.
Figure 25:
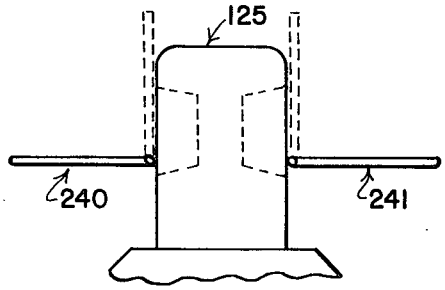

Referring to FIGS. 24 and 25, vane members of another configuration are indicated by the numerals 240, 241. The vane members 240, 241 are hingedly connected to disc structures in the manner of the vanes of FIGS. 22, 23. The vane members 240, 241 are movable between horizontally extended positions, as shown in solid lines in FIG. 25, and vertical sheltered positions as shown in phantom in FIG. 25. Moreover the vane members are positionable in flaring positions intermediate the extended and sheltered positions. When the vane members 240, 241 are in their horizontal extended positions, they may be rotated together and operate as diving planes. When the vane members are in flared positions, they may be rotated together to operate as diving planes or may be counter-rotated to provide a steering and heeling functions as described in conjunction with FIGS. 5–7.

The vane members 240, 241 are preferably constructed such that drag forces imposed on vane surface areas above and below their axes of rotation equalize when the vane members 240, 241 are folded and lie alongside their associated disc structures. By changing the proportion of vane member surface area near inner and outer ends of the vane members, they can be made to force-balance at selected flaring angles instead of in their fully folded positions.

Figure 26:
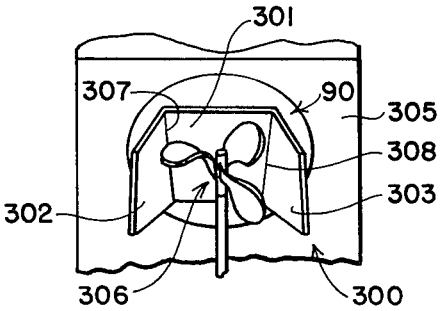
FIG. 26 is a perspective view of an alternate steering and stabilization device.

Referring to FIG. 26, still another steering and stabilization vane structure embodiment is indicated generally by the numeral 300. The vane structure 300 includes a mounting section 301 and a pair of flaring portions 302, 303 that depend obliquely from the mounting section 301. The described mounting and drive system embodiment 90 is preferably used to movably mount the vane structure 300 on the underside of a hull 305.

The vane structure 300 can be mounted above a ship's propeller 306 with the depending flaring portions 302, 303 on opposite sides of the propellor 306, as shown in FIG. 26. Alternatively, the vane structure can be mounted rearwardly of a ship's propellor. Regardless of its mounting position, the depending flaring portions operate to provide steering and heeling functions much in the manner illustrated in FIGS. 5–7. A disadvantage of this vane embodiment as compared with many of the foregoing embodiments is that the flaring portions 302, 303 are not movable to sheltered positions.

Figure 27:
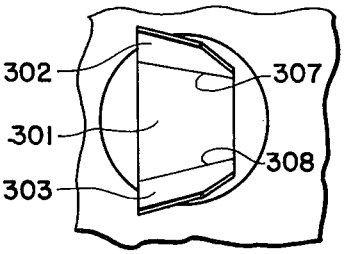
FIGS. 27 and 28 are bottom plan views showing modified forms of the device of FIG. 26.
Figure 28:
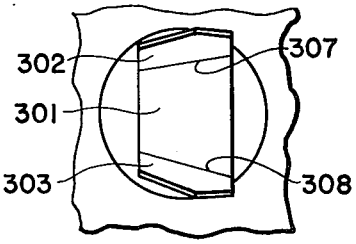
Figure 29:
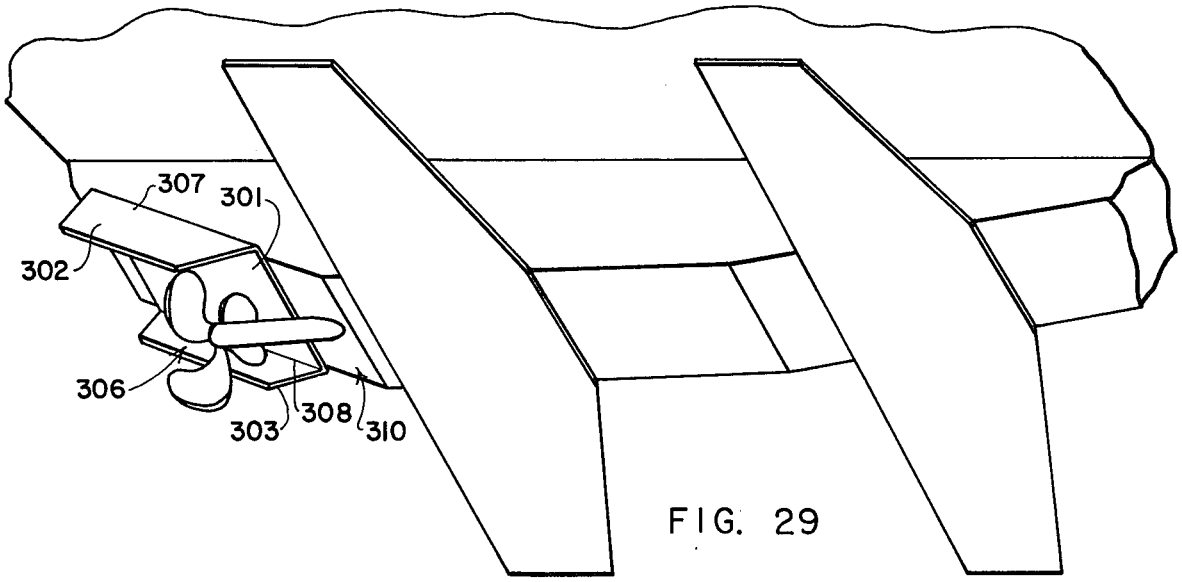
FIG. 29 is a perspective view of an alternate embodiment of the device of FIG. 26.

The flaring portions 302, 303 join the mounting section 301 along lines of juncture 307, 308. The lines of juncture 307, 308 can converge or diverge as illustrated in FIGS. 27 and 28, or can be parallel as shown in FIG. 29. The vane structure 300 can be mounted on a substantially horizontal hull portion 301, as shown in FIG. 26, or can be mounted on an inclined hull portion 310 as shown in FIG. 29.

Figure 30:
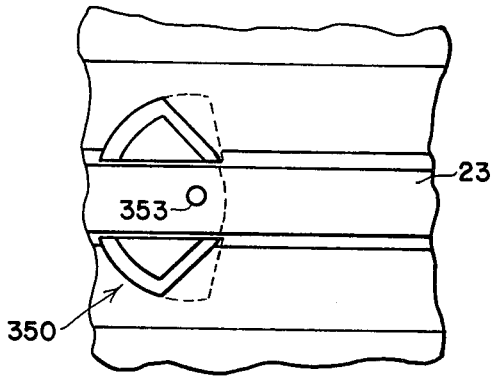
FIGS. 30 and 32 are bottom plan views of wave forming devices for use on the ship of FIGS. 1–4.
Figure 31:
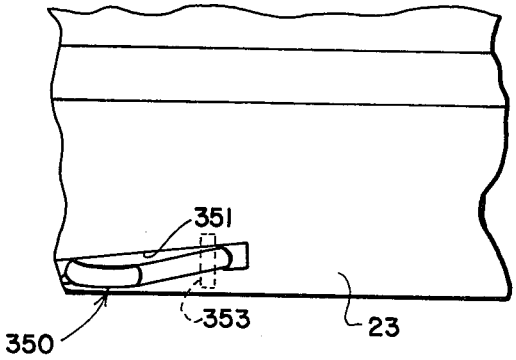
FIGS. 31 and 33 are side elevational views of the devices of FIGS. 30 and 32.

In accordance with another feature of the present invention, semi-displacement hydrofoil ships of the type shown in FIGS. 1–4 can be provided with wave forming devices to enhance their operation. Referring to FIGS. 30 and 31, one wave form generator embodiment is indicated by the numeral 350. The generator 350 extends through a slot 351 in the keel portion 23 of the ship's hull. The generator 350 is pivotally mounted for movement about an axis 353. Pivoting the generator 350 about the axis 353 operates to expose proportionately larger surface areas of the generator 350 on one side of the ship than on the other, thereby increasing drag forces on one side and diminishing them on the other. This adjusting of drag forces and the degree to which waves are generated on opposite sides of the ship provides a means of stabilizing the ship and controlling its heeling characteristics.

Figure 32:
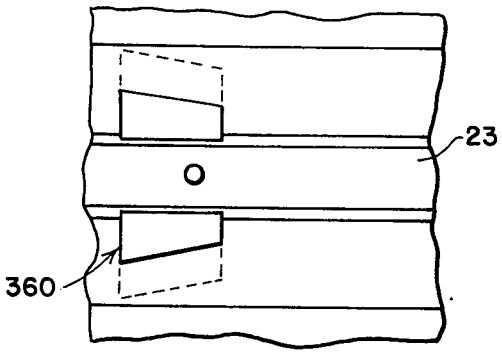
Figure 33:
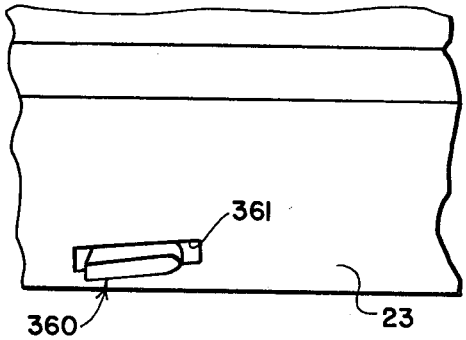

An alternate wave form generator embodiment 360 is shown in FIGS. 32 and 33. The generator 360 extends through a slot 361 in the keel portion 23 of the ship's hull. The generator 360 is slidably mounted for longitudinal movement between extreme positions shown in phantom in FIG. 32. The generator 360 operates in the same manner as the generator 350.

The described features may be used on ships of various types and in various combinations, as illustrated in FIGS. 34–42.

Figure 34:
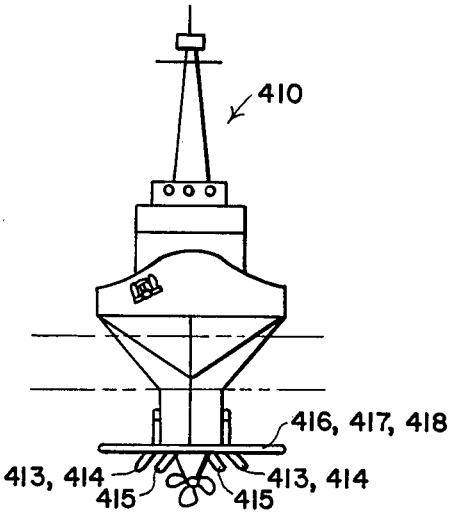
FIGS. 34, 35 and 36 are bow elevational views of other ship embodiments including features of the present invention.
Figure 37:
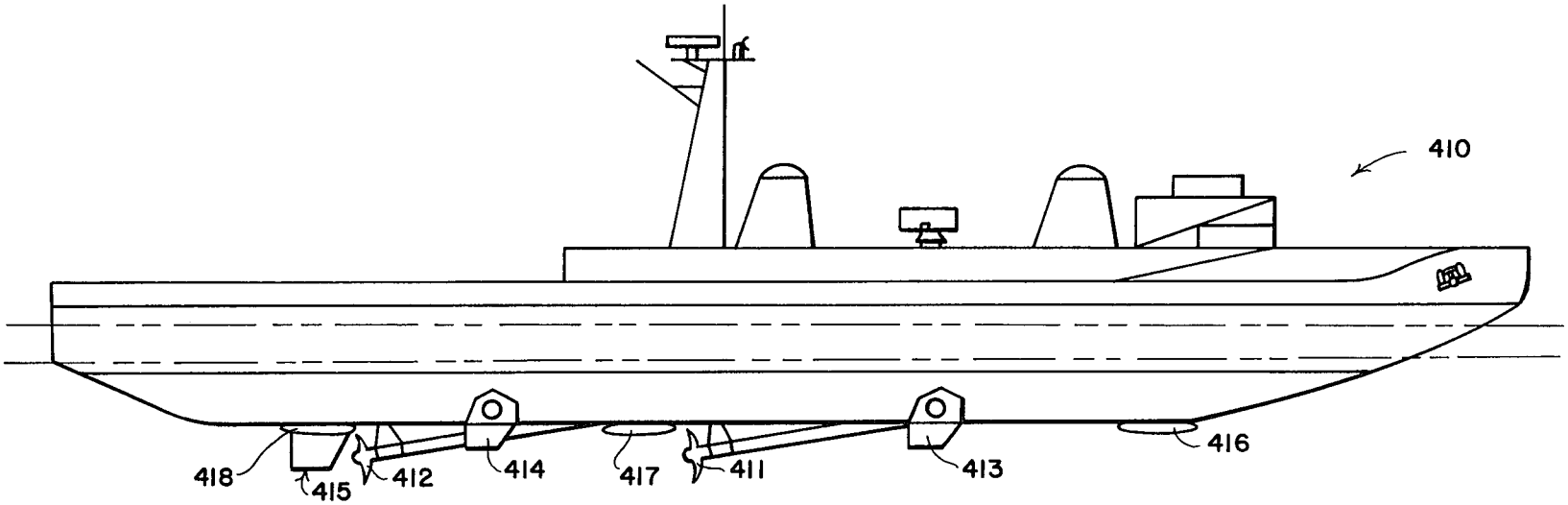
FIGS. 37, 39, and 41 are side elevational views of the ships of FIGS. 34, 35 and 36; and, FIGS. 38, 40 and 42 are bottom plan views of the ships of FIGS. 34, 35 and 36.
Figure 38:
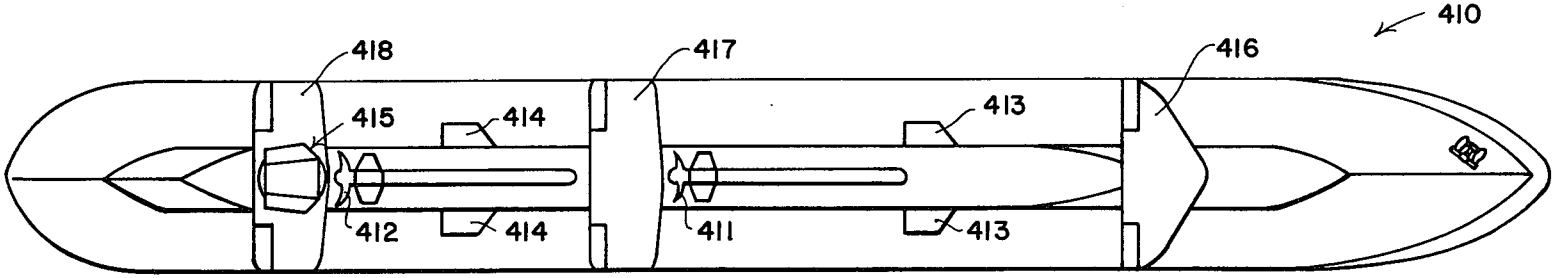

Referring to FIGS. 34, 37 and 38, a semi-displacement hydrofoil ship having a cross section similar to the ship of FIGS 1–4 is indicated generally by the numeral 410. The ship 410 has forward and rearward propellors 411, 412; forward and rearward pairs of side-mounted rotary vanes 413, 414 of the type shown in FIG. 12; and a vane structure 415 of the type shown in FIG. 28. Three hydrofoils 416, 417, 418 are mounted on the underside of the hull of the ship 410. The vane structure 415 is rotatably mounted on the rearward foil 418.

Figure 35:
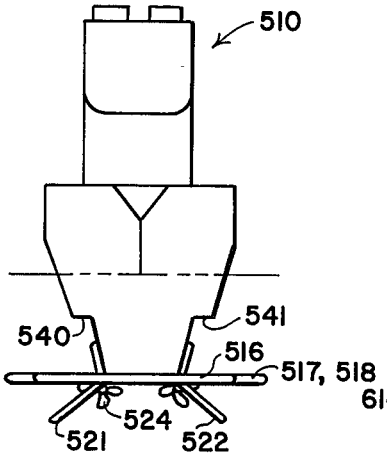
Figure 39:
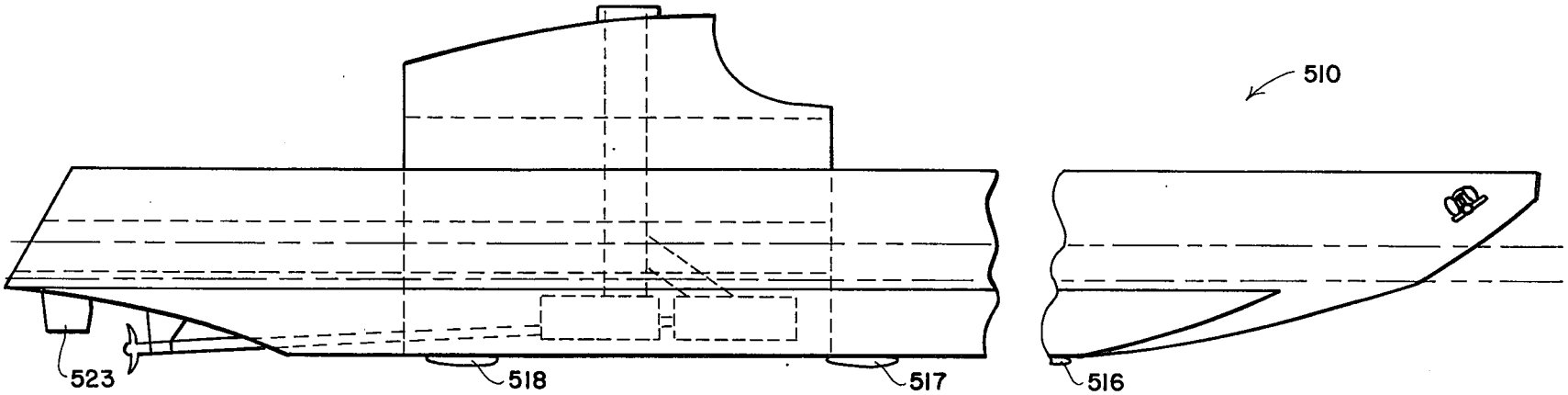
Figure 40:
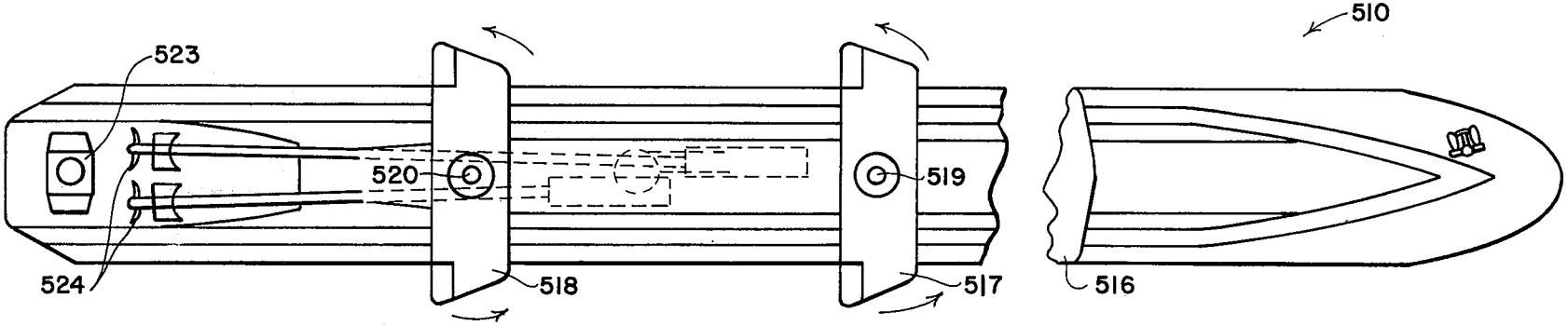

Referring to FIGS. 35, 39 and 40, another semi-displacement ship embodiment is indicated generally by the numberal 510.

The ship 510 includes hydrofoils 516, 517, 518 mounted on the underside of the ship's hull. The forward foil 516 is stationery and does not extend laterally beyond the maximum width of the ship's hull. The rearward foils 517, 518 are pivotally movable about axes 519, 520 for movement to storage positions where their lengths parallel the length of the ship 510. Side-mounted rotary vane members of the type indicated in FIG. 1 by the numeral 30 can be provided on the ship 510, as indicated by the numerals 521, 522 in FIG. 35.

A vane structure 523 of the type shown in FIG. 29 is mounted on the underside of the hull of the ship 510. The vane structure 523 is located rearwardly of two propellors 524, and operates in the wash of these propellors.

Referring to FIG. 35, one difference between the cross section of the ships 410, 510 is that the ship 510 includes downwardly facing, substantially horizontally extending hull portions 540, 541. The hull portions 540, 541 provide planing surfaces that are engaged by waves to assist in lifting the ship 510.

Figure 36:
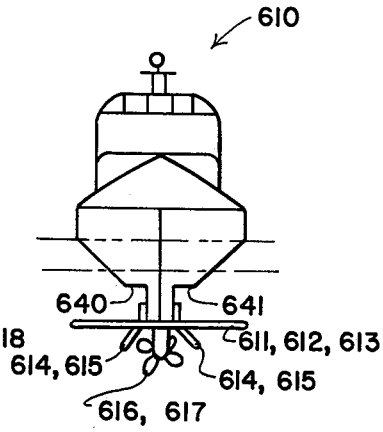
Figure 41:
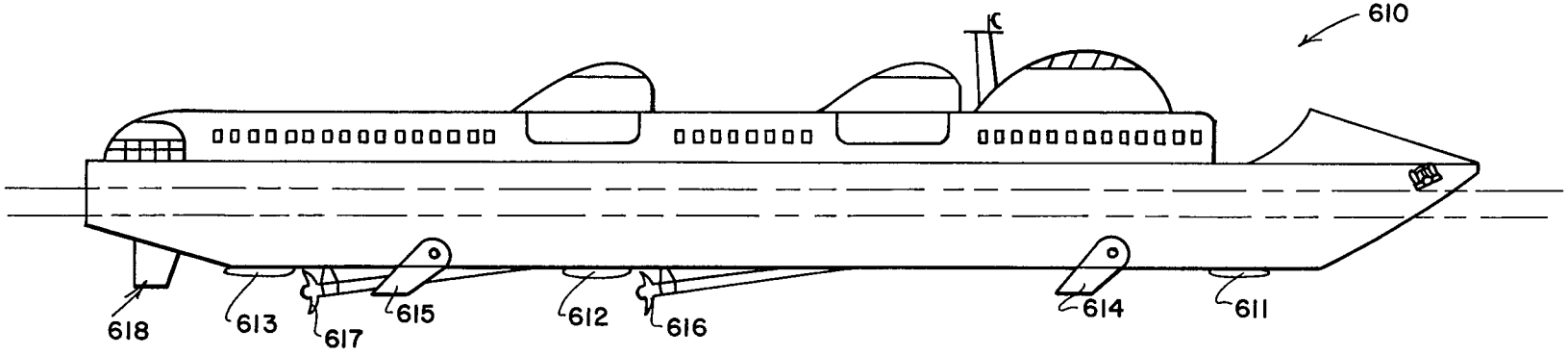
Figure 42:
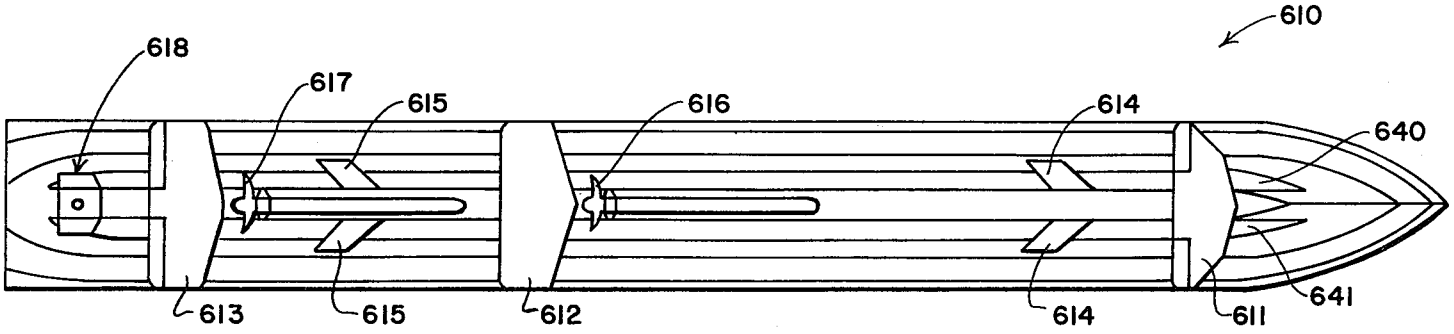

Referring to FIGS. 36, 41 and 42, still another ship embodiment is indicated by the numeral 610. The ship 410 is a passenger carrying vessel and utilizes a modified hull cross section including planing surfaces 640, 641. The ship 610 includes hydrofoils 611, 612, 613, forward and rearward pairs of side mounted vane members 614, 615, tandem propellors 616, 617, and a rotatably mounted vane structure 618. The vane members 614, 615 and the vane structure 618 may be operated in concert to steer and heel the ship 610.

Although the invention has been described in its preferred form with a certain degree of particularity, it is understood that the present disclosure of the preferred form has been made only by way of example and numerous changes in the details of construction and the combination and arrangement of parts may be resorted to without departing from the spirit and the scope of the invention as hereinafter claimed. It is intended that the patent shall cover, by suitable expression in the appended claims, whatever features of patentable novelty exist in the invention disclosed.

What is claimed is:

1. A watercraft, comprising;

a. an elongated hull;

b. a pair of elongated vane members having inner end regions near the hull and substantially planar outer end regions projecting away from the hull;

c. mounting means mounting the inner end regions on the hull for rotary movement about a common axis;

d. the substantially planar outer end regions extending in planes which obliquely intersect the common axis, to vanes being rotatably movable about the common axis to move such planes into and out of alignment with the flow- steam of water passing alongside the hull when the watercraft is moving forwardly to concurrently serve steering and heeling functions;

e. the vane members remaining substantially submerged while serving such steering and heeling functions.

2. The watercraft of claim 1 wherein the mounting means includes structure rigidly interconnecting the inner end regions for concurrent rotary movement about the common axis.

3. The watercraft of claim 1 wherein the mounting means includes at least one relatively large surface area water-lubricated bearing interposed between one of the inner end regions and the hull.

4. The watercraft of claim 1 additionally including drive means for, in one mode of operation, moving the vane members concurrently in opposite directions of rotation about the common axis, and, in another mode, for moving the vane members concurrently in the same directions of rotation about the common axis.

5. The watercraft of claim 1 wherein each of the vane members is rotatably movable between sheltered and extended positions where such planes align with the flowstream.

6. The watercraft of claim 1 wherein the common axis is substantially horizontal.

7. The watercraft of claim 1 wherein the common axis extends in a substantially vertical plane that parallels the length of the hull.

8. The watercraft of claim 1 additionally including pivotal mounting means forming pivotal connections between the inner end regions and the mounting means, and power operated drive means for pivoting the vane members relative to the mounting means between extended and sheltered positions.

9. The watercraft of claim 8 wherein said mounting means includes separate disc-like structures rotatably mounted by the mounting means on the hull, the drive means being connected to the disc-like structures.

10. A watercraft comprising:

a. a hull having relatively narrowly spaced opposite port and starboard side portions and having other opposite port and starboard side portions that are at least partially relatively widely spaced, as well as opposite port and starboard inclined intermediate portions joining said relatively narnowly spaced and said at least partially relatively widely spaced portions thereof;

b. port and starboard elongated vane members having inner end sections respectively positioned on and extending alongside said relatively narrowly spaced opposite port and starboard side portions of said hull, said port and starboard vane members further having substantially planar outer end sections; and, c. support means extending from said hull and connected to said inner end sections of said vane members to movably mount said vane members for rotary movement about a common axis between sheltered positions wherein said substantially planar outer end sections extend in planes which obliquely intersect said common axis and are disposed alongside said inclined intermediate portions of said hull and extended positions wherein said substantially planar outer end sections of said vane members extend away from said hull; said vane members being rotatably movable about said common axis to move said substantially planar outer end sections thereof into and out of alignment with the flowstream of water passing alongside said hull when said watercraft is moving forwardly to concurrently serve steering and heeling functions;

d. said vane members remaining substantially submerged while serving such steering and heeling functions.

11. The watercraft of claim 10 wherein said support means mount said vane members for rotation about a substantially horizontal axis.

12. The watercraft of claim 11 wherein such sections of said vane members as connect with said support means extend substantially vertically and other sections of said vane members which are spaced from said support means, at least in part, flare outwardly from said vertically extending sections.

13. The watercraft of claim 10 wherein said relatively closely spaced portions are submerged keel portions of a displacement hull ship, and said vane members extend below the ship's hull when in said extended positions.

* * * * *